US005382324A

United States Patent [19]

Fischer et al.

[11] Patent Number: 5,382,324

[45] Date of Patent: Jan. 17, 1995

[54] METHOD FOR ENHANCING PAPER STRENGTH

[75] Inventors: Stephen A. Fischer, Yardley; Nancy S. Clungeon, Wyndmoor; David I. Devore, Langhorne, all of Pa.

[73] Assignee: Henkel Corporation, Plymouth Meeting, Pa.

[21] Appl. No.: 68,447

[22] Filed: May 27, 1993

[51] Int. Cl.[6] ..... D21H 17/45

[52] U.S. Cl. ..... 162/168.2; 162/168.3

[58] Field of Search ..... 162/164.6, 168.2, 168.3

[56] References Cited

U.S. PATENT DOCUMENTS

| | | | |
|---|---|---|---|
| 3,728,214 | 4/1973 | Espy | 162/167 |
| 3,966,694 | 6/1976 | Espy et al. | 526/11.2 |
| 4,504,640 | 3/1985 | Harada et al. | 526/193 |
| 4,704,190 | 11/1987 | Harada et al. | 162/168.2 |
| 4,774,285 | 9/1988 | Pfohl et al. | 525/60 |
| 4,818,341 | 4/1989 | Degen et al. | 162/168.2 |
| 4,864,007 | 9/1989 | Schleusener | 526/218.1 |
| 4,880,497 | 11/1989 | Pfohl et al. | 162/135 |
| 4,940,514 | 7/1990 | Stange et al. | 162/168.2 |
| 4,978,427 | 12/1990 | Pfohl et al. | 162/168.2 |

FOREIGN PATENT DOCUMENTS

| | | | |
|---|---|---|---|
| 280445 | 8/1988 | European Pat. Off. | 162/168.2 |
| 2-112498 | 4/1990 | Japan | 162/164.6 |

OTHER PUBLICATIONS

Schuller, et al., "Soluble Copolymers of Diallyl Monomers", *Journal of Chemical and Engineering News*, vol. 4, No. 3., Jul., 1959, pp. 273–276.

*Primary Examiner*—Peter Chin

*Attorney, Agent, or Firm*—Ernest G. Szoke; Wayne C. Jaeschke; Henry E. Millson, Jr.

[57] ABSTRACT

Method for enhancing the strength of paper comprising the steps of

A) contacting paper fibers with a water slurry of at least one polymer which is a homopolymer and/or a random copolymer of an allylamine;

B) forming a paper sheet from the paper fibers; and

C) drying the paper sheet.

13 Claims, No Drawings

METHOD FOR ENHANCING PAPER STRENGTH

BACKGROUND OF THE INVENTION

1. Field of the Invention

This invention relates to the field of paper manufacture, and more particularly to a method for increasing the wet and dry strength of paper sheets.

2. Statement of Related Art

It is known in the field of paper manufacture to utilize certain polymeric materials as paper fillers or to increase the wet-strength and/or dry strenth of paper sheets. For example, U.S. Pat. No. 3,966,694 discloses retention aid resins which are used as paper fillers. These retention aid resins are aminohydroxyalkyl amino polymers and aminohydroxyalkyl quaternary ammonium polymers produced by reacting (1) a nitrogen-containing compound having the formula RRR'N wherein each R is independently selected from hydrogen and $C_1$–$C_4$ alkyl and R' is selected from hydrogen, $C_1$–$C_4$ alkyl and hydroxyl, with (2) certain base resins derived by reaction of a polymer containing a plurality of secondary and/or tertiary amino groups and an epoxide difunctional toward amines such as, for example, an epichlorohydrin; 1,2:3,4-diepoxybutane; 1,2:5,6-diepoxyhexane; diglycidyl ether; and 3,4-epoxy-(epoxyethyl) cyclohexane.

Schuller et al., "Soluble Copolymers of Diallyl Monomers" Journal of Chemical and Engineering News, pages 273–276 (July, 1959) discloses copolymers of acrylamide with diallyldimethyl ammonium chloride for the treatment of paper pulp.

U.S. Pat. No. 4,978,427 discloses the use of a copolymer of N-vinylformamide and an ethylenically unsaturated monomer to increase the wet and dry strength of paper.

U.S. Pat. No. 4,940,514 discloses the use of enzymatically degraded starch and a cationic polymer as a dry strength agent for paper.

U.S. Pat. No. 4,818,341 relates to the use of potato starch and amine polymers to impart high dry strength to paper.

U.S. Pat. Nos. 4,880,497 and 4,774,285 disclose a process for the use of a partially hydrolyzed copolymer of N-vinylformamide and an ethylenically unsaturated monomer as a paper additive, and the copolymers used in the process.

U.S. Pat. No. 3,728,214 discloses a resin consisting of a polyalkylene polyamine, an acrylamide, and a polyaldehyde as a wet and dry strength agent for paper. The polyamine can be a polyallylamine.

U.S. Pat. No. 4,864,007 discloses the homopolymerization of diallylamine and its derivatives, for use as pre- or after-treatment agents for anionic dyeings on textiles.

U.S. Pat. No. 4,504,640 discloses a process for polymerizing acid salts of monoallylamine to produce a homopolymer thereof.

DESCRIPTION OF THE INVENTION

Other than in the operating examples, or where otherwise indicated, all numbers expressing quantities of ingredients or reaction conditions used herein are to be understood as modified in all instances by the term "about".

A process for enhancing the wet and dry strength of paper has now been discovered, comprising the steps of A) contacting paper fibers with a water slurry of at least one polymer which is a homopolymer and/or a random copolymer of an allylamine;

B) forming a paper sheet from the paper fibers; and

C) drying the paper sheet.

The polymers that can be used in the practice of the invention are homopolymers and random copolymers of an allylamine. The allylamine is either monoallylamine or allyldiethylenetriamine, or can also be mixtures of the above in any proportions. Polyallylamine is preferred for use herein.

Comonomers that can be employed in addition to one or both of the above allylamines to form the copolymers of an allylamine are one or more nonionic or cationic vinyl-type monomers. Vinyl-type cationic quarternary ammonium monomers are preferred for use in forming these coploymers. Examples of nonionic and cationic vinyl-type monomers include but are not limited to the following: dimethyldiallylammonium chloride, dimethylaminoethyl acrylate, dimethylaminoethyl methacrylate, dimethylaminoethyl acrylate dimethylsulfate, dimethylaminoethyl methacrylate dimethylsulfate, dimethylaminoethyl acrylate methyl chloride, dimethylaminoethyl methacrylate methyl chloride, dimethylaminopropyl acrylamide, dimethylaminopropyl methacrylamide, methacrylamidopropyltrimethylammonium chloride, methacrylamidopropylhydroxyethyldimethylammonium acetate, isopropylaminopropyl methacrylamide, acrylamide, methacrylamide, n-methylolacrylamide, and diallylamine hydrochloride. Of the above, the preferred comonomer is dimethyldiallylammonium chloride. Copolymers containing one or more of the above comonomers contain from 5 to 99%, preferably from 25 to 95%, by weight of the allylamine component and from 1 to 95% preferably from 5 to 75% by weight of the comonomer component. The copolymers used in the process of the invention are formed from the reaction of the respective monomers so that both the-allylamine component and the comonomer component are present in random configuration in the backbone chains of the polymers, and essentially no side groups form during the reaction due to the fact that the amine groups in the allylamine component are completely protonated, i.e. in the form of a salt with HCl or other mineral acid.

The above homopolymers and copolymers are water soluble, nonthermosetting, and have a weight average molecular weight of from 20,000 to 500,000, preferably from 20,000 to 200,000, measured as the free base.

The above homopolymers and copolymers containing allylamine and/or allyldiethylenetriamine can be prepared according to the process of U.S. Pat. No. 4,504,640, which is expressly incorporated herein by reference. It is important in carrying out the reaction that the amine groups in the allylamine component are fully protonated, i.e. in the form of a salt with an inorganic acid such as HCl.

For certain paper applications it may be desired to crosslink the above homopolymers and copolymers, for example by reaction with from 0.5 to 2% by weight, based on the total weight of polymer, of a cross linking agent which is a diacrylate compound. Diacrylate compounds that can be employed for this purpose include but are not limited to one or more of 1,6-hexanediol diacrylate, methylenebis-acrylamide, ethylene glycol dimethacrylate, diethylene glycol dimethacrylate, and 1,3-butylene glycol dimethacrylate. The crosslinking reaction can take place in situ during the polymerization or copolymerization of the allylamine component, or by heating the homopolymer or copolymer, either separately or in the presence of the paper fibers, with the crosslinking agent to a temperature in the range of from 25° to 100° C. until crosslinking has taken place.

Alternatively, the noncrosslinked homopolymers and copolymers can be used to treat the paper fibers according to the process of the invention, and the handsheets prepared therefrom can then be post treated with a solution of the crosslinking agent.

The paper fibers in the form of a water slurry are contacted with the optionally crosslinked polymer, after the polymer has been treated with an aqueous base such as aqueous sodium hydroxide, to free the amine groups, at a temperature of from 25° to 95° C. Alternatively, if the fiber slurry contains enough base to free the amine groups of the polymer, the above base treatment step can be omitted. The concentration of polymer in the slurry is not critical, but is preferably adjusted so that the polymer adsorbed on the dry paper fibers is from 0.2 to 2%, preferably from 0.5 to 1% by weight, based on the weight of the paper fibers.

In step B) of the process, the aqueous slurry of paper fibers is formed into a sheet, using any standard method and equipment known to the field of paper manufacture, for example by preparing the slurry of polymer treated paper fibers, and after optional dilution with water, forming them into paper sheets on a Fourdrinier, in the deckle box of a Noble-Wood handsheet machine, or using the preparation method from the Mark IV Dynamic Handsheet/Mold Paper Chemistry Jar Assembly Operating Manual. Step C) is carried out by drying the wet paper sheet from step B). The sheet can be air dried at ambient temperature, e.g. 20° to 25° C., or at an elevated temperature in the range of 25° to 150° C. preferably from 100° to 110° C.

Paper treated with the homopolymers and copolymers of the invention show surprising wet and dry tensile strengths, which are in fact comparable to polyaminoamide-epichlorohydrin (PAE) resins and are comparable to or superior to other polyamine resins used in the treatment of paper fibers, such as polyethylenimine. Moreover, use of the present homopolymers and copolymers eliminates the problem of absorbable organic halides associated with the use of PAE resins. In addition, the treated paper of the invention is readily repulpable, since the present polymers are water soluble and are not thermosetting. In fact, repulping can be carried out more completely than with paper treated with commercial resins such as PAE and other polyamine-epichlorohydrin resins. Moreover, the present homopolymers and copolymers are compatible with typical papermaking additives such as starch, cationic starch, cationic retention aids such as cationic acrylamide coploymers, carboxymethyl cellulose, alkyl ketene dimer sizing agent, and the like.

The invention will be illustrated but not limited by the following examples.

EXAMPLES

Preparation of Copolymers

Example 1

Preparation of a random copolymer of dimethyldiallylammonium chloride (DADMAC) and allylamine (85:15 wt. ratio).

To a 250 ml round bottom glass reactor, equipped with a paddle agitator, nitrogen inlet, thermometer, and reflux condenser, were added 90.7 g of a 60% solution of DADMAC, 9.8 g of monoallylamine, and 16.9 g of 37% HCl. The reactants were mixed while heating to 70° C. under a nitrogen purge. At 70° C. 20.0 g of a 7% solution of 2,2' azobis (2-amidopropane) dihydrochloride was added over 6 hours. The reactants were held at 70° C. (approximately 15 hours) until conversion was greater then 90% by titration for residual unsaturation. The reaction mass was cooled to 50° C. and 13.8 g of 50% NaOH was added. About 1 g of unreacted allylamine was removed by vacuum distillation at 90° C. The resulting polymer solution contained about 34.6% actives, a Brookfield viscosity of about 4,310 cps, a total alkalinity of 39.2 mg KOH/g polymer solution, a pH of 10.3, and about 0.27% of unreacted allyl unsaturation.

Example 2

Preparation of a random copolymer of acrylamide and allylamine (85:15 wt. ratio).

To a 250 ml round bottom glass reactor, equipped with a paddle agitator, nitrogen inlet, thermometer, and reflux condenser, were added 111.9 g of water, 2.6 g of monoallylamine, 27.5 g of 52.3% solution of acrylamide, and 4.5 g of 37% HCl. The reactants were mixed while heating to 70° C. under a nitrogen purge. At 70° C. 20.0 g of a 7% solution of 2,2'azobis (2-amidopropane)dihydrochloride was added over 6 hours. The reactants were held at 70° C. (approximately 15 hours) until conversion was greater than 90% by titration for residual unsaturation. The reaction mass was cooled to 50° C. and 3.5 g of 50% NaOH was added. The resulting polymer solution contained about 9% actives, and a Brookfield viscosity of about 445 cps.

Example 3

Preparation of random copolymer of dimethyldiallylammonium chloride (DADMAC) and allyldiethylenetriamine (allylDETA) (95:5 wt. ratio).

To a 250 ml round bottom glass reactor, equipped with a paddle agitator, nitrogen inlet, thermometer, and reflux condenser, were added 100.0 g of a 60% solution of DADMAC, 3.2 g of allylDETA (Dow Chemical Co, Midland, Mich. ) and 5.3 g of 37% HCl. The reactants were mixed while heating to 70° C. under a nitrogen purge. At 70° C. 20.0 g of a 7% solution of 2,2'azobis (2-amidopropane)dihydrochloride was added over 6 hours. The reactants were held at 70° C. (approximately 15 hours) until conversion was greater than 90% by titration for residual unsaturation. The reaction mass was cooled to 50° C. and 4.3 g of 50% NaOH was added. The resulting polymer solution contained about 35.2% actives a Brookfield viscosity of about 800 cps, a total alkalinity of 25.5 mg KOH/g polymer solution and a pH of 10.2.

Preparation of Pulp Slurry Stock

Example 4

Commercial bleached Kraft, or unbleached pulp (brown stock) furnishes were diluted with tap water to a concentration of about 0.2%, based on the weight of the slurry.

Preparation of Handsheets

Example 5

Blank handsheets were prepared according to the handsheet preparation method outlined in the Mark IV Dynamic Handsheet Mold/Paper Chemistry Jar Assembly Operating manual. Treated handsheets were prepared by the same method except a quantity of homopolymer or copolymer sufficient to produce the polymer on the dry fibers in about 0.5% by weight was added to the fiber slurry and the furnish was mixed at 750 rpm for 60 seconds. Handsheets were blotted dry between felt sheets and pressed with a rolling pin in back and forth and diagonal directions. Pressed sheets were dried on a Williams Dryer for 10 minutes at 105° C. and oven cured at 105° C. for 10 minutes. All oven cured handsheets were conditioned at 50% relative humidity for 24 hours before measuring tensile strengths. Handsheets not cured in the oven were naturally cured at 25° C. and 50% relative humidity for 7 days.

Tensile strengths of the handsheets were obtained as follows:

Tensile strips measuring 1" by 4" were cut from the treated handsheets and soaked for 1 hour in water at 25° C. (wet tensiles). Tensile strengths were determined on an Instron Tensile Tester using a 10 lb. load cell. The tensiles are reported as % wet strength (wet tensile/dry tensile×100). Dry tensile strengths are the strengths of the strips not soaked in water.

The molecular weights of the copolymers of Examples 1–3 were determined according to the procedure given in Nagy, D. J., Terwilliger, D. A., "Size Exclusion Chromatography/Differential Viscometry of Cationic Polymers", Journal of Liquid Chromatography, 12(8), 1431–1499, 1989 colums: CATSEC 100, 300, 1000
mobile phase: 0.1%TFA/0.2%NaNO3
conditions: 0.5 ml/min, 35° C. 100 uL injection
detection: SHODEX TM refractive index
method: B:MPCAT
sample prep: 0.5% solutions on solids basis were prepared in the mobile phase and passed through 0.45 micron filters before analysis
calibration: a narrow calibration curve was generated using polyvinylpyrrolidone standards that were dissolved in the mobile phase and passed through 0.45 micron filters before analysis. The molecular weight distribution of the allylamine homo- and co-polymers were calculated with respect to the standards.

Example 6

Wet strength data for homopolymers and copolymers of the invention and for resins in commercial use.

| Resins of the invention | Source | MW by GPC |
|---|---|---|
| polyallylamine | Monomer-Polymer 4 Dajac Labs | 178K |
| DADMAC-Allylamine copolymer | Example 1 | 125K |
| DADMAC-allylDETA copolymer | Example 3 | 36K |
| **Comparison Resins** | **Source** | **MW by GPC** |
| polyaminoamide-epichlorohydrin PAE resin | Fibrabon 33 ®, Henkel | 128K |
| polyamine-epichlorohydrin resin | Fibrabon 35 ®, Henkel | 129K |
| polyethylenimine | Polymin ® P, BASF | 70K |

| Wet Strength Resin | % Wet Strength |
|---|---|
| a. Bleached Tissue Stock, 7-Day Natural Cure, 0.5% wet strength resin on dry fiber | |
| polyallylamine | 19.7 |
| polyethylenimine | 9.4 |
| PAE | 23.0 |
| Blank | 2.9 |
| b. Bleached Tissue Stock, Oven Cure, 0.5% wet strength resin on dry fiber | |
| polyallylamine | 21.2 |
| polyethylenimine | 11.2 |
| PAE | 23.5 |
| Blank | 4.2 |
| c. 100% Bleached 2° Fiber, Oven Cure, 0.5% wet strength resin on dry fiber | |
| polyallylamine | 17.5 |
| polyethylenimine | 16.0 |
| PAE | 15.7 |
| Blank | 3.5 |
| d. Brown Stock, Mill A, Oven Cure, 0.5% wet strength resin on dry fiber | |
| polyallylamine | 25.9 |
| PAE | 29.1 |
| Blank | 13.2 |
| e. Brown Stock, Mill B, Oven Cure, 0.5% wet strength resin on dry fiber | |
| polyallylamine | 15.0 |
| polyethlylenimine | 15.0 |
| PAE | 24.0 |
| Polyamine-epichlorohydrin | 18.0 |
| Blank | 5.5 |
| f. Brown Stock, Mill B, Oven Cure, 0.5% wet strength resin on dry fiber | |
| polyallylamine | 13.6 |
| DADMAC-allylamine copolymer | 8.6 |
| DADMAC-allylDETA copolymer | 7.0 |
| PAE | 16.1 |
| Polyamine-epichlorohydrin | 16.8 |
| Blank | 3.5 |

Example 7

Repulping of cured handsheets

Cured handsheets were repulped according to Tappi method T-205 om-88 section 7.1 except that disintegration time was 40 seconds and the repulped consistency was 1.0%. The disintegrated pulp was filtered through a 0.15 mm slotted vibrating screen and the fiber bundles that did not pass through the slots were dried, weighed, and reported as % repulped.

| Repulping Data | | |
|---|---|---|
| Wet Strength Resin | % Wet Strength | % Repulped |
| polyallylamine | 13.6 | 95.9 |
| DADMAC-allylDETA copolymer | 7.0 | 99.4 |
| PAE | 16.1 | 69.7 |
| polyamine-epichlorohydrin | 16.8 | 82.6 |
| Blank | 3.5 | 99.7 |

What is claimed is:

1. A method for enhancing the strength of paper comprising the steps of

A) adding to a water slurry of paper fibers an aqueous solution of at least one polymer which is a water soluble random copolymer consisting of an allylamine selected from the group consisting of monoallylamine, allyldiethylenetriamine, and mixtures thereof and at least one nonionic or cationic vinyl monomer selected from the group consisting of dimethylaminoethyl acrylate, dimethylaminoethyl methacrylate, dimethylaminoethyl acrylate dimethylsulfate, dimethylaminoethyl methacrylate dimethylsulfate, dimethylaminoethyl acrylate methyl chloride, dimethylaminoethyl methacrylate methyl chloride, dimethylaminopropyl acrylamide, dimethylaminopropyl methacrylamide, methacrylamidopropyltrimethylammonium chloride, methacrylamidopropylhydroxyethyldimethylammonium acetate, isopropylaminopropyl methacrylamide, acrylamide, methacrylamide, and n-methylolacrylamide, wherein the aqueous solution has a pH of at least about 10 and is added in a quantity sufficient to provide from about 0.2 to about 2% by weight of polymer on the paper fibers, based on dry paper fibers, and wherein the copolymer consists of from about 5 to about 99% by weight of the allylamine and from about 95 to about 1% by weight of the vinyl monomer;

B) forming a paper sheet from the paper fibers; and

C) drying the paper sheet.

2. The method of claim 1 wherein in step A) the at least one polymer has a molecular weight of from about 20,000 to about 500,000.

3. The method of claim 2 wherein said molecular weight is from about 20,000 to about 200,000.

4. The method of claim 1 wherein the nonionic or cationic vinyl monomer is at least one cationic quaternary ammonium monomer.

5. The method of claim 1 wherein the at least one polymer is crosslinked with from about 0.5 to about 2% by weight of at least one diacrylate compound, based on the total weight of polymer.

6. The method of claim 5 wherein the diacrylate compound is at least one of 1,6-hexanediol diacrylate, ethylene glycol dimethacrylate, diethylene glycol dimethacrylate, and 1,3-butylene glycol dimethacrylate.

7. The method of claim 1 wherein from about 0.5 to about 1% of polymer is present or the dry paper fibers.

8. The method of claim 1 wherein step A) is carried out at a temperature in the range of from about 25° to about 95° C.

9. The method of claim 1 wherein step C) is carried out at a temperature in the range of from about 20° to about 150° C.

10. The method of claim 9 wherein said temperature is in the range of from about 50° to about 105° C.

11. The method of claim 1 wherein in step A) the at least one polymer consists of from about 25 to about 95% by weight of the allylamine and from about 75% to about 5% of vinyl monomer, and has a molecular weight of from about 20,000 to about 500,000, and step A) is carried out at a temperature in the range of from about 25° to about 95° C.

12. The dry paper sheet produced by the method of claim 1.

13. The dry paper sheet produced by the method of claim 11.

* * * * *